US008091144B2

(12) United States Patent
Sigmon et al.

(10) Patent No.: US 8,091,144 B2
(45) Date of Patent: Jan. 10, 2012

(54) FLAMEPROOF, HEAT RESISTANT, ONE-PIECE ESCAPE SUIT

(76) Inventors: Kennis L. Sigmon, Norfolk, VA (US); R. Bruce Watson, Virginia Beach, VA (US); Joseph A. Slivinski, Peckville, PA (US); Louis V. Ott, Clarks Summit, PA (US); Stephen J. Clock, Chesapeake, VA (US)

( * ) Notice: Subject to any disclaimer, the term of this patent is extended or adjusted under 35 U.S.C. 154(b) by 640 days.

(21) Appl. No.: 11/801,145

(22) Filed: May 9, 2007

(65) Prior Publication Data

US 2008/0276357 A1 Nov. 13, 2008

(51) Int. Cl.
*A62B 17/00* (2006.01)
*A62D 5/00* (2006.01)

(52) U.S. Cl. ..... 2/81; 2/458

(58) Field of Classification Search ..... 2/456, 458, 2/81, 901

See application file for complete search history.

(56) References Cited

U.S. PATENT DOCUMENTS

| | | | | |
|---|---|---|---|---|
| 2,761,515 | A | 9/1956 | Field, Jr. et al. | |
| 4,227,262 | A * | 10/1980 | Insulan et al. | 2/2.16 |
| 4,860,382 | A | 8/1989 | Markwell | |
| 4,998,296 | A | 3/1991 | Stames | |
| 5,119,515 | A * | 6/1992 | Altinger | 2/457 |
| 5,421,326 | A | 6/1995 | Rankin et al. | |
| 5,774,902 | A | 7/1998 | Gehse | |
| 5,794,262 | A | 8/1998 | Capello | |
| 5,829,840 | A | 11/1998 | Goeckel | |
| 5,860,162 | A | 1/1999 | Love | |
| 5,888,652 | A * | 3/1999 | Berbner et al. | 428/389 |
| 5,948,708 | A * | 9/1999 | Langley | 442/131 |
| 6,032,285 | A * | 3/2000 | Densen | 2/456 |
| 6,297,178 | B1 * | 10/2001 | Berbner et al. | 442/302 |
| 6,510,560 | B1 | 1/2003 | Ugolnik | |
| 6,841,791 | B2 * | 1/2005 | DeMeo et al. | 250/515.1 |
| 7,128,207 | B2 | 10/2006 | Anderson et al. | |
| 2008/0134407 | A1 * | 6/2008 | Winterhalter et al. | 2/79 |

* cited by examiner

*Primary Examiner* — Alissa L Hoey
*Assistant Examiner* — Amber Anderson
(74) *Attorney, Agent, or Firm* — David L. Banner

(57) ABSTRACT

A flameproof, heat resistant, lightweight, one-piece escape suit which includes attached integral mitts or gloves, covered footing, and a hood. The fire and heat resistant one piece suit is designed to be worn over a commercial smoke hood, is formed from a metalized fabric, and meets the requirements of ASTM standard D6413. The suit is designed to be easily slipped onto a wearer's body over typical street clothing, and allows a wearer to wear his or her accustomed footwear for improved safety and comfort. The durable fabric provides protection to a wearer when crawling low to the ground on his or her knees and elbows as is often recommended as a preferred escape posture. The fire and heat resistant one piece suit may be provided in multiple sizes to fit adults and children. The fire and heat resistant one piece suit, as well as a smoke hood, may be packaged into compact, lightweight emergency escape kit bag with unique "glow in the dark" lettering; FIRE ESCAPE KIT suitable for carrying between home and work, etc.

9 Claims, 7 Drawing Sheets

FLAMEPROOF, HEAT RESISTANT, ONE-PIECE ESCAPE SUIT

BACKGROUND OF THE INVENTION

1. Field of the Invention

The invention pertains to protective garments, and, more specifically to a lightweight, flameproof, heat resistant, one-piece escape suit.

History abounds with horrific stories of fires where numerous people perish when they are trapped in a burning building. In recent years, the proliferation of skyscrapers and other high rise structures has exacerbated this situation, and it is now estimated that 200 million people live and/or work in more than 80,000 skyscrapers worldwide. While modern buildings are substantially fireproof, many people still succumb to smoke, heat or other toxic fumes resulting from the burning of furniture or other building contents before they can be rescued. This typically happens when people cannot escape from a building because their escape path may take them through a burning portion of the structure.

While fire fighters have an incredible history of performing selfless, heroic acts to rescue occupants from within burning structures, the extraordinary number of people often present in a high rise structure makes the rescue task virtually impossible. What is needed, therefore, is an effective, inexpensive protective garment that may be easily donned, and that will protect a person from smoke and fire during his or her passage out of a burning building. Such a garment should protect its wearer from radiant heat, smoke or other toxic fumes as well as prevent severe burns to their body when passage through a region of a burning building is necessary to escape the structure.

2. Discussion of the Related Art

High rise evacuation systems exist wherein a wall-mounted bracket and pulley system is used in conjunction with a fireproof cable and controlled descent device to lower people from an upper building floor to the ground. These devices are typically used in conjunction with an "evac suit" that is essentially a glorified metalized fabric bag into which one or more people secure themselves for the descent. Such systems suffer from the fact that they must be permanently installed and become part of the building structure. In addition, such systems are only effective in high rise spaces having access to the outside, leaving occupants of interior spaces stranded. Such systems also have a relatively high initial cost, and routine maintenance becomes expensive. High Rise Escape Systems of Sanford, Fla. USA markets an exemplary escape system.

Fireproof protective garments and shelters are also known in the prior art. However, such garments are typically worn only by firefighters or other professionals, as they may be expensive, bulky, heavy, and cumbersome, require training in their use, or require ancillary support systems for their use. Such garments typically require several minutes and an assistant to don. Therefore, such garments are not suitable for use as escape garments that may be deployed in offices, hotel rooms, or other spaces in high rise structures for use by untrained civilians.

One such garment is disclosed in U.S. Pat. No. 2,761,515 for PROCESS AND APPARATUS FOR FIRE PROTECTION, issued Sep. 4, 1956 to Theophilus A. Field, Jr. et al. FIELD, JR. et al. provide an outer garment for placement over conventional inner garments. A space formed between the inner and outer garments is filled with foam that insulates the wearer from the heat of a fire. The foam is usually replenished from an external source throughout the use of the garment.

U.S. Pat. No. 4,860,382 for PROTECTIVE GARMENT, issued Aug. 29, 1989 to Edgar R. Markwell, teaches a hazmat garment adapted to protect a wearer from noxious chemicals and vapors, but having neither fire-resistant nor flameproof qualities.

U.S. Pat. No. 4,998,296 for HYPOTHERMIA PROTECTION SUIT COLLAPSIBLE INTO COMPACT PACKAGE FOR STORAGE, issued Mar. 12, 1991 to Rebecca M. Stames, teaches a thin, compressible garment having inner and outer layers surrounding an open cell foam central layer. The STAMES garment is a bag having a closable bottom and closable sleeves for enclosing a wearer. The STAMES garment is useful, for example, for protecting a motorist stranded during a blizzard from hypothermia, but is not suitable for use as a fire escape garment.

U.S. Pat. No. 5,421,326 for HEAT RESISTANT SUIT WITH ACTIVE COOLING SYSTEM, issued Jun. 6, 1995 to R. Dewon Rankin et al., shows a suit having means for circulating cooling air within a closed inner region thereof.

U.S. Pat. No. 5,774,902 for PROTECTION SUIT, issued Jul. 7, 1998 to Harmut Gehse, discloses a protective suit suitable for pilots or drivers. An outer protective layer encloses a fluid layer that is controlled by external apparatus.

U.S. Pat. No. 5,794,262 for FIRE-PROOF PROTECTIVE WEARING OUTFITS WITH DIFFERENTIATED PERSPIRABILITY, issued Aug. 18, 1998 to Giuseppe Capello, provides an air-permeable safety suit for use in industrial activities, fighting forest fires, etc.

U.S. Pat. No. 5,829,840 for SAFETY SEAT, issued Nov. 3, 1998 to Patrick Goeckel, discloses a passenger seat having a storage compartment for storing a safety suit.

U.S. Pat. No. 5,860,162 for INFLATABLE FIREPROOF AVIATION BODY SUIT, issued Jan. 19, 1999 to Roy M. Love, provides a flexible, inflatable suit.

U.S. Pat. No. 6,510,560 for ROLLER-SUIT AND APPAREL, issued Jan. 28, 2003 to Adam Ugolnik, discloses a protective suit having rollers disposed on the external surface thereof, allowing a wearer to roll along a surface such as a floor.

U.S. Pat. No. 7,128,207 for EMERGENCY FIRE SHELTER STORAGE SYSTEM, issued Oct. 31, 2006 to Leslie Leah Anderson et al., provides a compact fire shelter stored in a pouch for emergency withdrawal and use.

None of these prior art systems or patents, taken singly or in combination, is seen to anticipate or suggest the one-piece, lightweight flameproof, heat resistant, one-piece escape suit of the present invention.

SUMMARY OF THE INVENTION

In accordance with the present invention, there is provided a flameproof, heat resistant, lightweight, one-piece escape suit which includes attached mitts and foot covers, and an attached outer hood. The flame and heat resistant one-piece escape suit may be combined with a suitable commercial smoke hood well known to those of skill in the art and provided as a portable, lightweight kit. The escape suit of the invention is both compact and lightweight making it suitable for carrying between home and work, and during business or recreational travel, etc. It is low enough in cost that kit may be deployed at multiple locations, for example at home, at an office, in a dormitory room, or other location frequented by the suit's owner. The kit is low enough in cost that it may be deployed in quantity in hotel or motel rooms, offices, public assembly points, etc. for use by persons trapped in that location.

The lightweight escape suit of the invention may readily be donned by a person when confronted with an emergency event situation. The fire and heat resistant, one-piece escape suit is typically used with a commercially available smoke hood and is provided in multiple sizes to fit adults and children.

The fire and heat resistant, one-piece escape suit is specifically designed for emergency fire and heat escape. Accordingly, the features of the unique fire and heat resistant, one-piece escape suit design provide continuous protection as a wearer crawls low to the ground on his or her knees and elbows, as is often recommended as a preferred escape posture.

Designed to be easily slipped on over typical street clothing, the escape suit has attached hand and foot covers (e.g., mitts and boots) that allow a user to wear his or her accustomed footwear for improved safety and comfort.

It is, therefore, an object of the invention to provide a lightweight fire and heat resistant, one-piece escape suit.

It is another object of the invention to provide a lightweight escape suit that may be readily donned over street clothing.

It is an additional object of the invention to provide a lightweight escape suit that includes attached hand covering, foot coverings, and an attached hood that may be pulled over a conventional commercial smoke hood.

It is a further object of the invention to provide a lightweight escape suit that may typically be donned in approximately one minute or less.

It is a still further object of the invention to provide a lightweight escape suit for use with a conventional smoke hood that provides approximately 15-30 minutes of smoke protection.

It is yet another object of the invention to provide a lightweight escape suit that meets or exceeds the requirements of the ASTM D6413 standard.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides a lightweight, fireproof, heat resistant, one-piece (i.e., flameproof) escape suit suitable for civilian (i.e., non-firefighter, non-police, non-military, non-rescue personnel) use. The escape suit may routinely be carried by a person from home to an office, or on a trip, etc. for use during an unexpected fire emergency event. The novel escape suit may be quickly donned (typically in a minute or less by a non-handicapped adult). A smoke hood (typically included in a kit with the fire and heat resistant, one-piece escape suit of the invention) is worn under the suit's hood.

Figure 1:
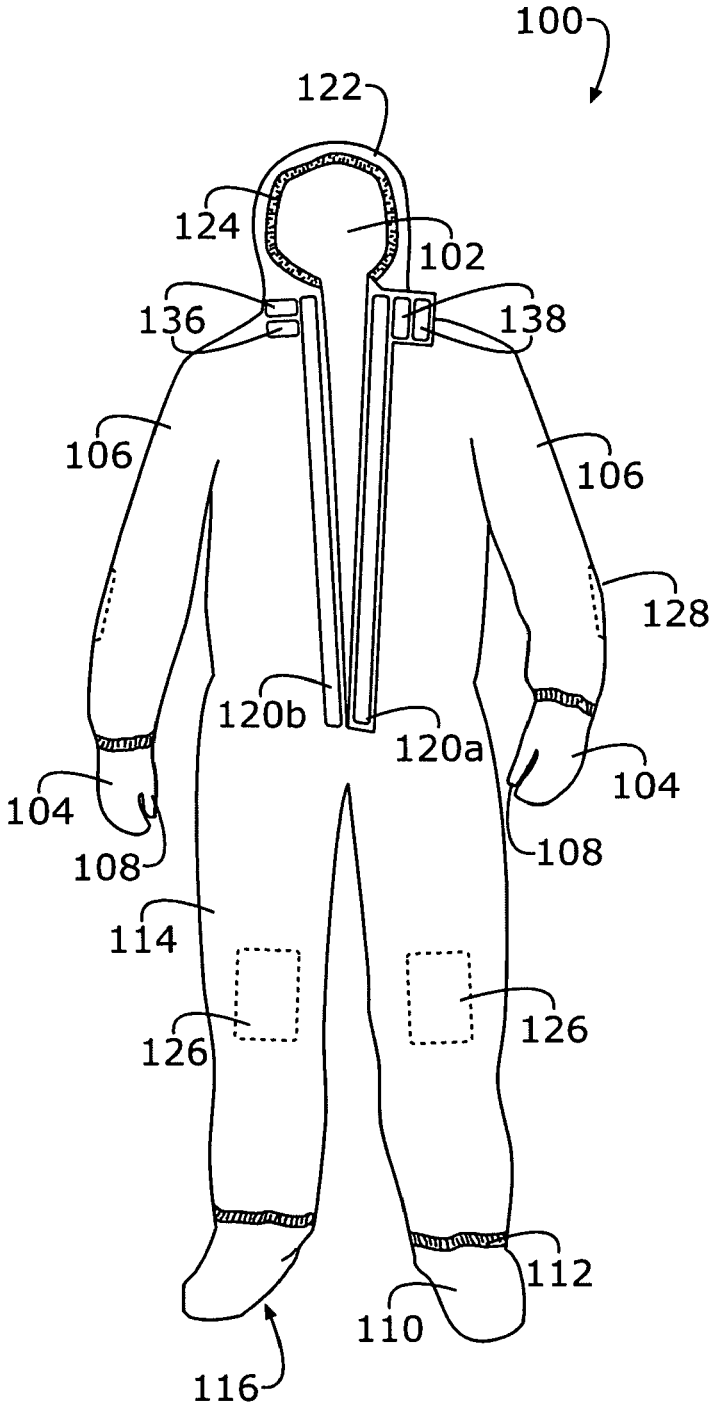
FIG. 1 is a front, elevational, schematic view of a first embodiment of the escape suit of the invention disposed on a wearer thereof.

Referring first to FIG. 1, there is shown a front, perspective, schematic view of a first embodiment of the escape suit of the present invention, generally at reference number 100. Escape suit 100 covers the entire body of the wearer, not specifically identified, exposing only a face region 102 thereof.

Figure 5:
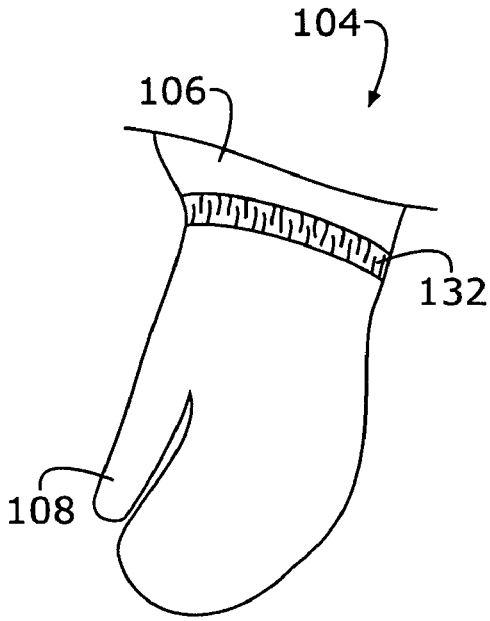
FIG. 5 is a detailed, schematic view of an attached mitt region of the escape suit of FIG. 1 or 2.
Figure 6A:
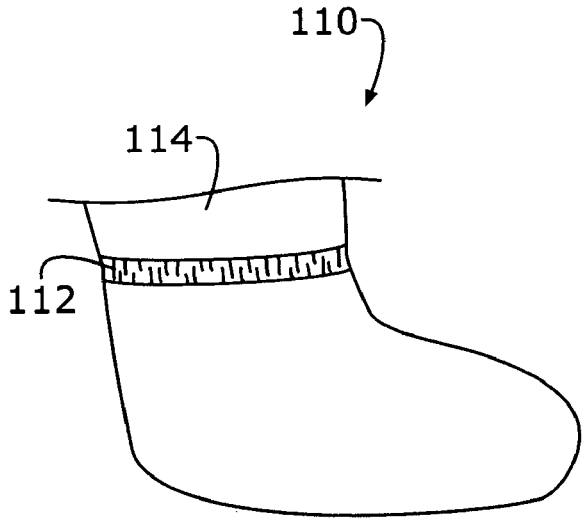
FIGS. 6*a* and 6*b* are side and rear elevational, schematic views of a boot region of the escape suit of FIG. 1 or 2.
Figure 6B:
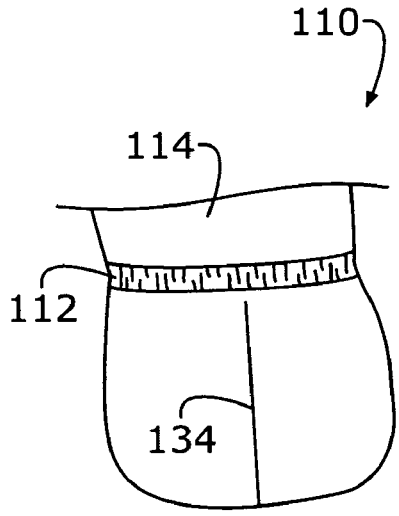

Refer now also to FIG. 5. Integral hand coverings 104 (e.g., mitts or gloves) are typically permanently attached to sleeves 106 of escape suit 100. Mitts or gloves 104 typically contain separate thumbs 108 to aid a wearer in manipulating an object if and when required. It will be recognized, however, that alternate hand covering constructions are possible, for example, a mitt without a thumb region may be provided. Consequently, the invention is not limited to the hand coverings chosen for purposes of disclosure, but covers any and all possible suitable variants of hand protection.

Mitts or gloves 104 are typically integral with sleeve 106 for several reasons. First, a separate glove or mitt 104 could become separated from fire and heat resistant, one-piece escape suit 100 and be mislaid. Second, an integral glove or mitt construction ensures that no leaks or exposures occur at the intersection of glove or mitt 104 and sleeve 106 when the fire and heat resistant, one-piece escape suit 100 is quickly donned by a user during a fire or other emergency event. Third, an integral glove or mitt 104 minimizes the manufacturing cost, allowing deployment of the inventive escape suits 100 more widely, and therefore potentially protecting a greater population.

An elastic band 132 is provided at the juncture of glove or mitt 104 at the juncture of sleeve 106 (i.e., the wrist region of the wearer of escape suit 100). Elastic band 132 helps ensure a snug fit keeping the sleeves 106 and gloves or mitts 104 properly in place on the wearer's body.

While attached gloves or mitts 104 are chosen for purposes of disclosure, it will be recognized that gloves or mitts 104 could be provided in a detached configuration with a suitable attachment means, not shown, provided. Such attachment mechanisms are believed to be known to those of skill in the art and are not further described herein. The invention, therefore, includes both integral and detachable gloves or mitts 104.

Figure 7A:
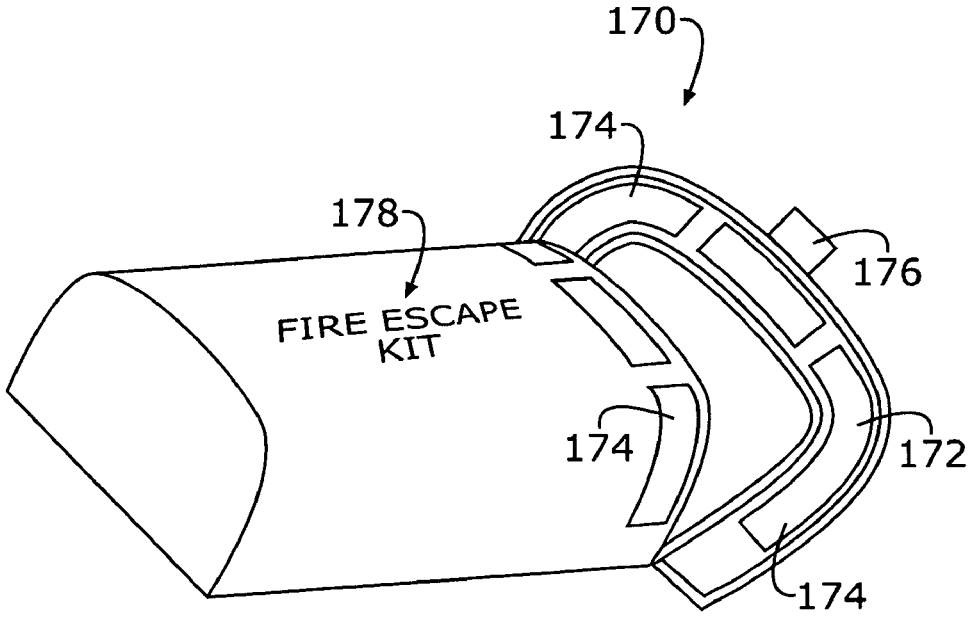
FIGS. 7*a* and 7*b* are side and rear perspective, schematic views of a container for holding at least the escape suit of FIG. 1 or 2 to from an escape kit.
Figure 7B:
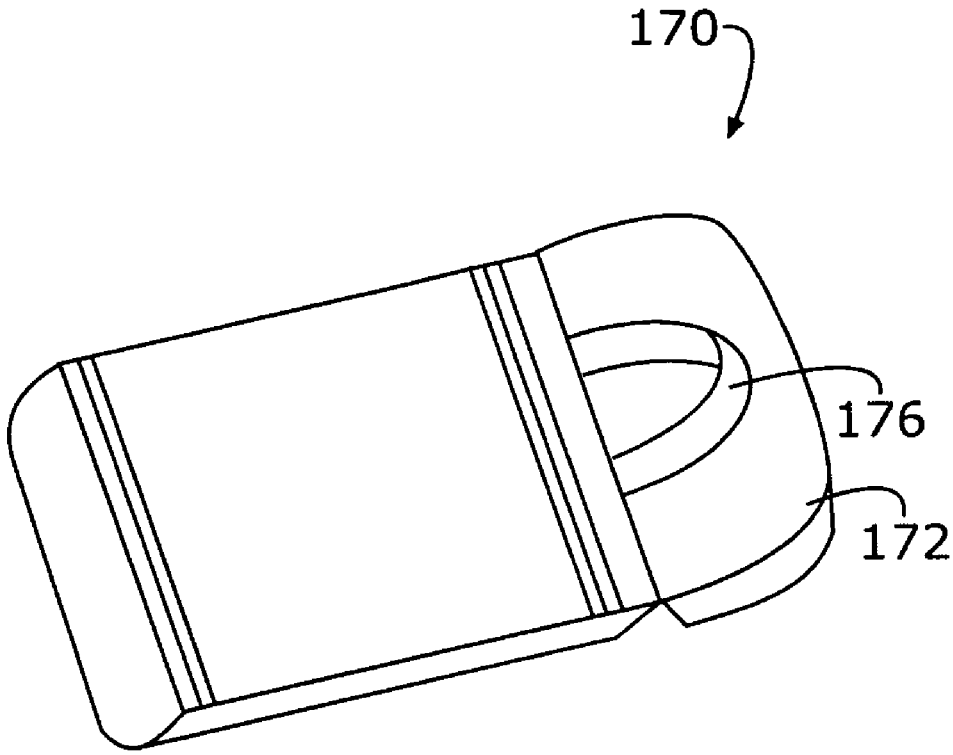

Refer now also to FIGS. 7*a* and 7*b*. Integral foot coverings 110 are attached to fire and heat resistant, one-piece escape suit 100 at the distal ends of legs 114. Elastic bands 112 are typically sewn in escape suit 100 at the distal ends of legs 114 to snug the bottoms of legs 114 around the wearer's ankles or shoe tops. Foot coverings 110 are designed to easily fit over a wearer's street shoes or other footwear, neither shown. Bottom surfaces 116 of foot coverings 110 may be reinforced and may have a non-skid surface treatment. A vertical seem 134 is typically disposed in the rear of foot coverings 110.

A front, central opening is provided to allow a user to slip into escape suit 100 in a manner similar to donning a pair of coveralls. In the embodiment of escape suit 100 A closure flap 118 secures the front region of escape suit 100. Several closure systems may be used. For example, hook-and-loop (i.e., Velcro®) strips 120*a*, 120*b* may be used. In alternate embodiments of fire and heat resistant, one-piece escape suit 100 described hereinbelow, other fastening mechanisms are provided.

An integral hood 122 is designed to create a form fitted interface around the users face region 102 using an elastic band 124 sewn into hood 122.

Horizontally disposed hook-and-loop patches 136 and vertical hook-and-loop patches 138 are disposed proximate the upper ends of hook-and-loop strips 120*a*, 120*b* at the neck region of escape suit 100. Hook-and-loop patches 136 and 138 interact to tightly close escape suit 100 at the neck of the wearer.

Reinforced pads 126 may be provided at the knees of suit 100. Reinforced knee pads 126 typically are placed on an interior surface of legs 114 because any material placed on an exterior surface of suit 100 typically tends to reduce the reflectivity of suit 100 and creates a potential burn-through point therein.

Escape suit 100 may be formed from a metalized (typically aluminized) fabric such a fiber glass. One material found suitable for the application is Gentex™ aluminized woven fiberglass fabric, Type; 1299-074. The Gentex™ fabric is produced by a patented Dual Mirror® double-layer aluminization process that yields a fabric weighing only approximately 180 g/m$^2$. This lightweight fabric allows the construction of escape suit 100 with a total weight of between approximately two and three pounds depending upon the size of escape suit 100.

All seams, for example, seem 134 in foot covering 110 are sewn with heat-resistant thread. Nomex® thread has been found suitable for the application. To provide extra protection from dangerous chemicals and vapors seeping into the suit through the seams, an additional piece of Gentex™ or similar fabric may be heat-sealed over each seam.

The exterior of the fire and heat resistant, one-piece escape suit 100 is highly reflective to aid emergency workers in spotting a wearer of escape suit 100 in a dark or smoky environment.

Figure 2:
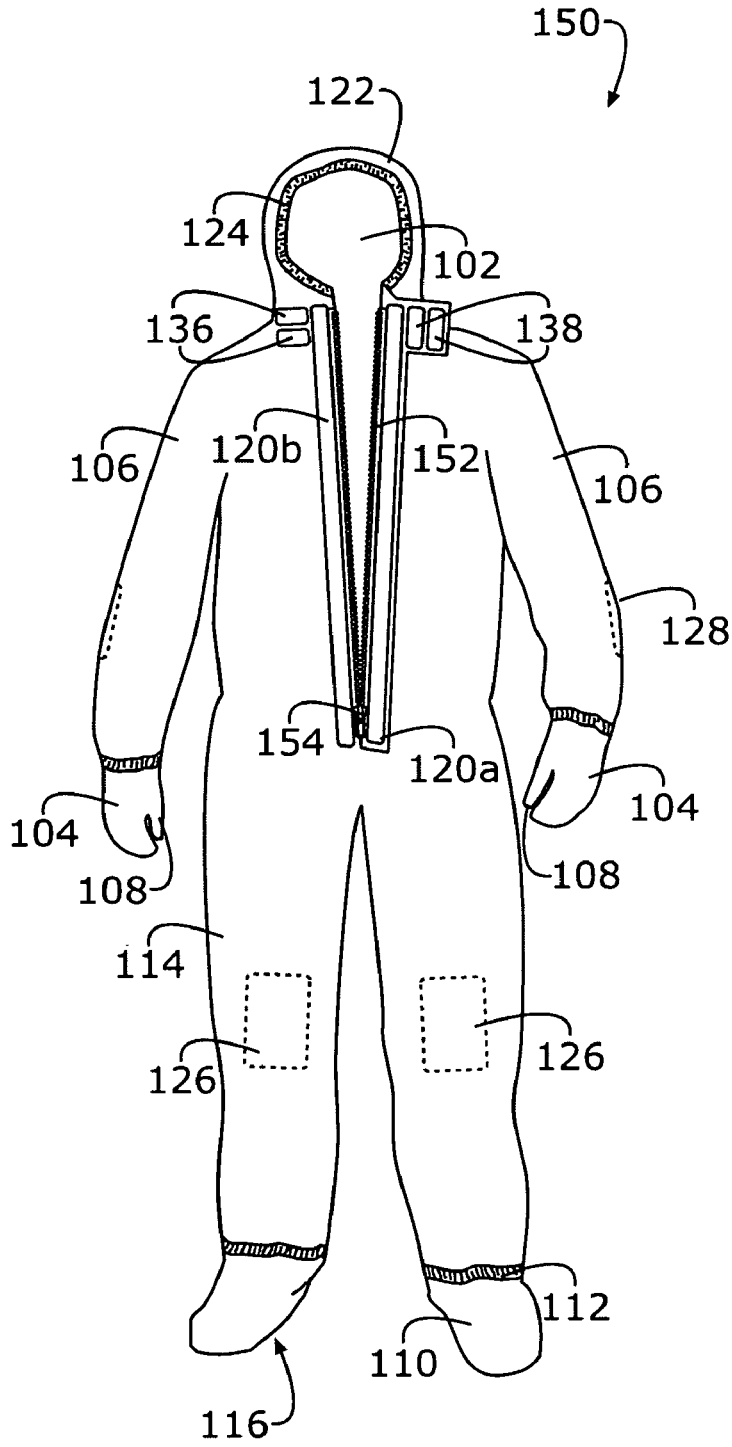
FIG. 2 is a front, elevational, schematic view of an alternate embodiment of the escape suit of the invention disposed on a wearer thereof.

Referring now to FIG. 2, there is shown a front, elevational, schematic view of an alternate embodiment of the fire and heat resistant, one-piece escape suit, generally at reference number 150. The only substantive difference between the fire and heat resistant, one-piece escape suit 100 (FIG. 1) and escape suit 150 is that the hook-and-loop fastener strips 120*a*, 120*b* (FIG. 1) are replaced by a zipper 152. A lanyard 154, which also is typically made from a fire-resistant material, may be attached as an operator for zipper 152. A barrel clasp or other similar structure may be placed at the end of lanyard 154. As there are few fundamental differences between escape suit 100 (FIG. 1) and escape suit 150, the designation: escape suit 100, will be used generically to refer to any embodiment of the inventive fire and heat resistant, one-piece escape suit.

Figure 3:
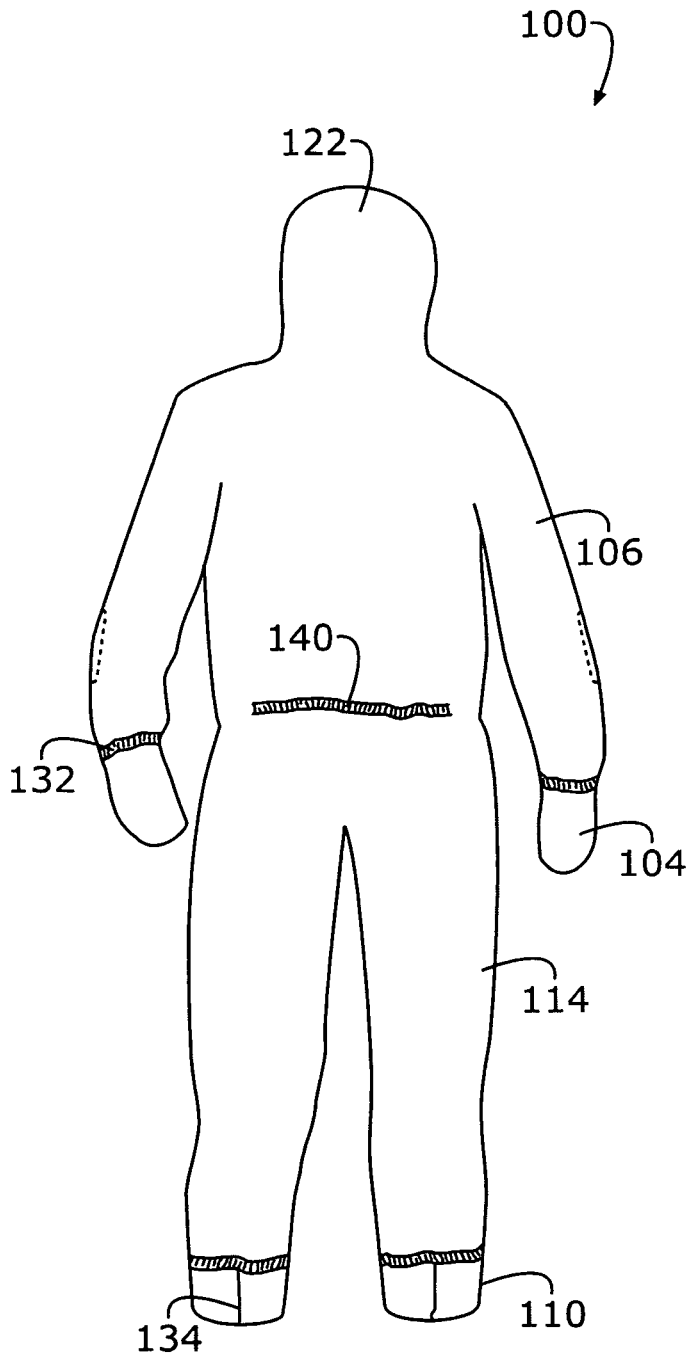
FIG. 3 is a rear, elevational, schematic view of the escape suit of FIG. 1 or 2 disposed on a wearer thereof.

Referring now to FIG. 3, there is shown a rear elevational, schematic view of the escape suit 100, 150 of FIG. 1 or 2, respectively. Elastic 140 is disposed in a central region of escape suit 100 to snug the suit around the abdomen of a wearer.

Figure 4:
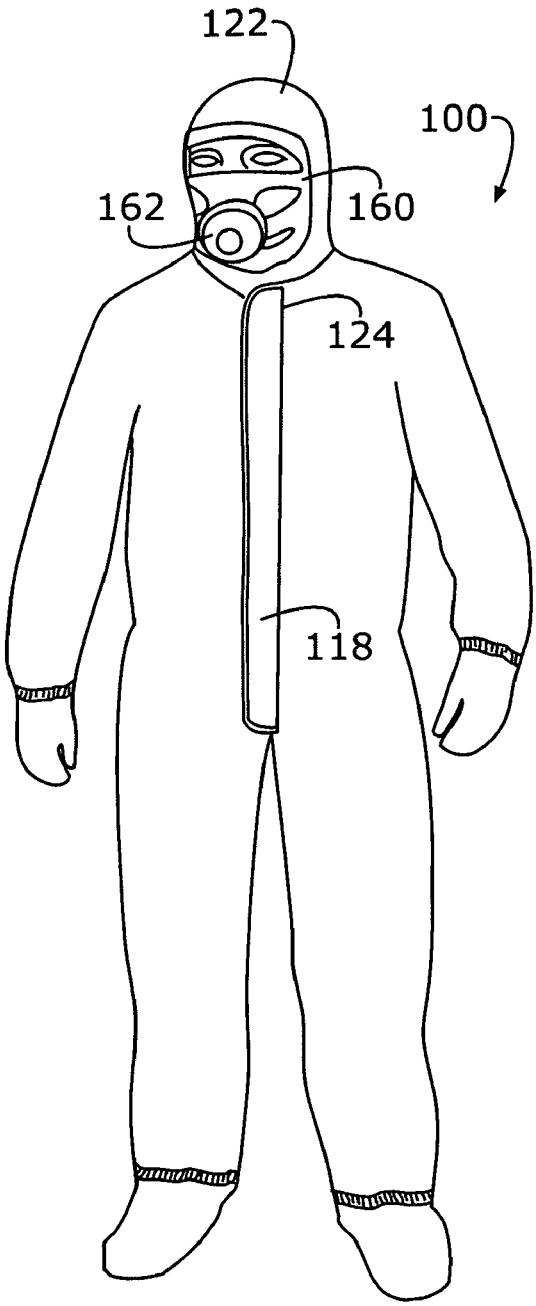
FIG. 4 is a front, perspective, schematic view of the escape suit of FIG. 1 or 2 with a smoke hood in place on the wearer's face.

Referring now to FIG. 4, there is shown a front, elevational, schematic view of the fire and heat resistant, one-piece escape suit 100 in place on a wearer. In addition to suit 100, the wearer has a conventional smoke hood 160 on his or her head under hood 122.

Smoke hoods 160 are believed to be well known to those of skill in the art. Smoke hoods are typically constructed of heat-resistant material like Kapton® or the like, and can withstand relatively high temperatures. They typically completely surround a wearer's head and allow breathing only through a canister containing a filter that provides protection from smoke and the toxic by-products of combustion. Virtually all smoke hood designs utilize some form of an activated charcoal filter and particulate filter to screen out corrosive fumes like chlorine, as well as acid gases like hydrogen chloride and hydrogen sulfide. The defining characteristic of an effective smoke hood is the ability to convert deadly carbon monoxide to relatively harmless carbon dioxide through a catalytic process.

The escape suit 100 of the present invention is designed to work cooperatively with a commercial smoke hood. A type such as the Purify Air 30M from CY Holding Company, LTD or a Mine Safety Appliance S-CAPE Smoke Hood have been found suitable for the application. However, it will be recognized that virtually any smoke hood 160 may be worn with escape suit 100, 150, as the smoke hood per se forms no part of the invention.

Smoke hood 160 completely surrounds the head of a wearer. Filter canister 162 is visible in front of the mouth and nose of the wearer.

The inventive escape suit 100 has been evaluated in the test facilities at North Carolina State University, College of Textiles, Textile Protection & Comfort Center, and 2401 Research Drive, Raleigh, N.C. 27695-8301. A specially instrumented manikin called "Pyro-Man" was used to perform flame resistance tests in accordance with the ASTM test method F 1930 (Standard Test Method for Evaluation of Flame Resistant Clothing for Protection Against Flash Fire Simulations Using an Instrumented Manikin). ASTM F 1930 evaluates the probable severity burning of a wearer of protective clothing. The test result is expressed in terms of the degree of burn and the percentage of body area likely to be burned. To successfully meet the requirements of ASTM F 1930, the protective clothing must limit second degree burning to a maximum of 50% of the body.

As stated in ASTM F 1930, the "Pyro-Man" was fitted with cotton T-shirt and briefs under fire and heat resistant, one-piece escape suit 100 and was then subjected to a 3 second flux of flame with a 2.0 cal/cm$^2$ intensity. The temperature during the test was approximately 3000° F. The test results indicated that escape suit 100 performed well. Less than 40% of "Pyro-Man" received second degree burns, thus exceeding the requirements of the specification.

Further tests were performed with the addition of a wool sweater and polyester/wool trousers added over the cotton T-shirt and briefs on "Pyro-Man". Under these conditions (which are believed to much more realistically mimic real world conditions), "Pyro-Man" experienced no second or third degree burning. Utilizing the same fire and heat resistant, one-piece escape suit 100, an additional 3 second flux of flame was applied; the results again were zero second or third degree burns.

Although not a standard test, the flame time was increased from 3 seconds to 5 seconds. With the wool sweater and polyester/wool trousers over the cotton T-shirt and briefs, only a remarkable 4.1% second degree burning was recorded.

(6) The fire and heat resistant one piece suit should provide extensive radiant heat protection to the individual user. This invention provides a tolerance time to second degree burns of 58.01 seconds.

Referring now to FIGS. 7*a* and 7*b*, there are shown side and rear perspective views of a container (i.e., a kit bag) 170 adapted to hold fire and heat resistant, one-piece escape suit 100 and a commercial smoke hood, 160 (FIG. 4). When completely inside kit bag 170, a kit bag lid 172 may be used to seal escape suit 100 and the commercial smoke hood within container 170. Hook-and-loop patches 174 disposed on the body of kit bag 170 and on lid 172 are used to secure lid 172 in a closed position thereby retaining escape suit 100 and smoke hood 160 therein. A loop handle 176 is disposed on kit bag 170 to facilitate carrying the escape kit formed. Optional accessories, not shown, for example, a flashlight, a whistle, clicker, or other noise maker, or similar device may be included in the escape kit packaged within kit bag 170. When required, a hermetically sealed package, not shown, may be created. The inventive fire and heat resistant, one-piece escape suit 100 may be compacted into a very small kit bag 170. When a smoke hood 160 is included, an overall kit bag size is in the range of approximately 14 inches×4 inches×7 inches may be achieved.

Kit bag 170 may have optional indicia 178, for example "FIRE ESCAPE KIT", or similar nomenclature may be applied on an outside surface of kit bag 170. Indicia 180 may be printed in a glow-in-the-dark ink or paint to facilitate locating the escape kit in a dark space. It will be recognized that numerous variations of indicia including English language phrases as well as foreign language text or symbols may be placed on kit bag 170. In still other embodiments, universal symbols may form part of indicia 178.

The inventive escape suit 100 is believed to perform best when provided to a wearer in an approximately "correct" size conforming to his or her body. Consequently, it is anticipated that the inventive escape suit may be provided in multiple sizes to fit a wide range of people.

It is anticipated that the inventive escape suit will be worn only once and discarded after use. It will also be recognized that multi-use escape suits may be fabricated using the design of the present invention. Consequently, the invention is not considered limited to single use escape suits 100.

In operation, two primary scenarios are examined. In a first scenario, a person carries an emergency fire and heat resistant, one-piece escape suit 100 with them in a brief case, suitcase, or the like. In this manner, a business traveler, for example, may have an escape suit nearby in his or her hotel room, meeting room, etc.

In a second scenario, kits containing the inventive escape suit may be pre-deployed in hotel/motel rooms, offices, public meeting rooms, ship state rooms, high rise condos and apartments, or other such locations. This strategy is similar to the provision of life jackets in ship staterooms. In an emergency event, people present in the space may don an available, previously deployed escape suit 100.

While not designed as a "hazmat" suit, the novel fire and heat resistant, one-piece escape suit 100 of the invention is anticipated to protect a wearer in situations other than a simple house or building fire. For example, in the much dreaded "dirty bomb" scenario, the inventive escape suit 100 may protect against radiant heat and smoke components caused thereby. It is also possible that the metalized fabric could also possibly provide some protection against alpha and beta radioactive particles as well. However, there is no intention of representing the novel escape suit 100 as more than a flame-proof and heat resistant fire escape suit.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A flameproof, heat resistant, lightweight, one-piece escape suit, consisting of:

a) a body portion formed from a composite fabric having a fiber glass layer and two aluminized layers, said composite fabric having a weight of approximately 180 grams per square meter, said body portion being adapted to completely cover a torso of a wearer and comprising a central front opening disposed along a major axis thereof, said central front opening starting at a central point of a face opening of said body portion and extending to a waist region thereof, said central opening being selectively openable to allow donning of said suit by said wearer and selectively closable to completely enclose said torso;

b) sleeves formed from said composite fabric attached to said body portion for completely covering the arms of said wearer, said sleeves each having a distal end with a hand covering attached thereto, said hand covering completely enclosing a hand of said wearer;

c) leg portions formed from said composite fabric attached to said body portion at a lower region thereof for covering the legs of said wearer, each of said leg portions having a distal end and a foot covering attached to said leg portion thereat; and d) a hood portion formed from said composite fabric attached to an upper region of said body portion and adapted to surround a commercial smoke hood disposed on the head of said wearer, said hood portion comprising a face opening having a perimeter comprising a elastic band disposed only around said perimeter for securing said hood around the face of a wearer over said commercial smoke hood, said hood being free from any other elastic member.

2. The flameproof, heat resistant, lightweight, one-piece escape suit as recited in claim 1, wherein said suit has a total weight in the range of between approximately two and three pounds.

3. The flameproof, heat resistant, lightweight, one-piece escape suit as recited in claim 1, wherein said hand covering comprises at least one selected from the group: gloves and mitts.

4. The flameproof, heat resistant, lightweight, one-piece escape suit as recited in claim 3, wherein said hand covering comprises a mitt having a distinct thumb region.

5. The flameproof, heat resistant, lightweight, one-piece escape suit as recited in claim 1, further comprising:

e) at least one seam disposed in at least one selected from the group: said body portion, said sleeves, said hand coverings, said leg portions, said foot coverings, and said hood, said seam being sewn with heat-resistant thread.

6. The flameproof, heat resistant, lightweight, one-piece escape suit as recited in claim 1, further comprising:

f) an elastic region formed proximate at least one of said distal end of at least one of said sleeves and said distal end of said leg portions and lower portion of the back.

7. The flameproof, heat resistant, lightweight, one-piece escape suit as recited in claim 1, wherein said suit exceeds the requirements of ASTM standard D6413.

8. The flameproof, heat resistant, lightweight, one-piece escape suit as recited in claim 7, wherein said suit, when tested in accordance with ASTM F 1930 results in zero body burns after two three second applications of a 3000 degree F. to an instrumented manikin wearing said flameproof, heat resistant suit.

9. A fire emergency escape kit, comprising:

a) a lightweight, heat resistant, one-piece flameproof escape suit in accordance with claim 1, b) a smoke hood, and c) a kit bag for containing said fire and heat resistant one piece escape suit and said smoke hood, the kit bag d) with unique "glow in the dark" lettering, FIRE ESCAPE KIT e) a kit bag will contain flashlight, and f) a clicker (noise maker).

* * * * *